United States Patent [19]

Salzer

[11] 4,315,234

[45] Feb. 9, 1982

[54] COMPOSITE FUSIBLE ELEMENT AND ELECTRIC FUSE COMPRISING THE ELEMENT

[76] Inventor: Erwin Salzer, P.O. Box 45, Waban, Mass. 02168

[21] Appl. No.: 168,960

[22] Filed: Jul. 14, 1980

[51] Int. Cl.[3] ..... H01H 85/06; H01H 85/12

[52] U.S. Cl. ..... 337/159; 337/292

[58] Field of Search ..... 337/159, 160, 158, 161, 337/162, 290, 291, 292, 293, 294, 295

[56] References Cited

U.S. PATENT DOCUMENTS 2,781,434 2/1957 Swain ..... 337/159
2,809,257 10/1957 Swain ..... 337/159
3,543,209 11/1970 Kozacka ..... 337/159
3,543,210 11/1970 Kozacka ..... 337/159

FOREIGN PATENT DOCUMENTS 1213736 11/1970 United Kingdom ..... 337/292

*Primary Examiner*—Harold Broome
*Attorney, Agent, or Firm*—Erwin Salzer

[57] ABSTRACT

A composite fusible element for electric fuses comprising a pair of spaced drawn wires substantially circular in cross-section, at least one pair of spaced plates of sheet metal in contact with said pair of wires, and electrical bonds conductively connecting each of said pair of wires and one of said pair of plates. The pair of wires is preferably of silver, and the pair of plates is preferably of copper. A fuse according to the invention includes a fusible element as described above.

10 Claims, 10 Drawing Figures

FIG. 6
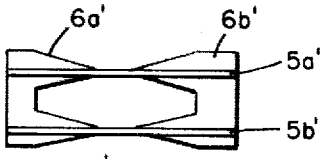
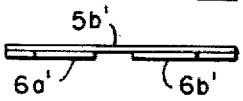
FIG. 7
FIG. 8
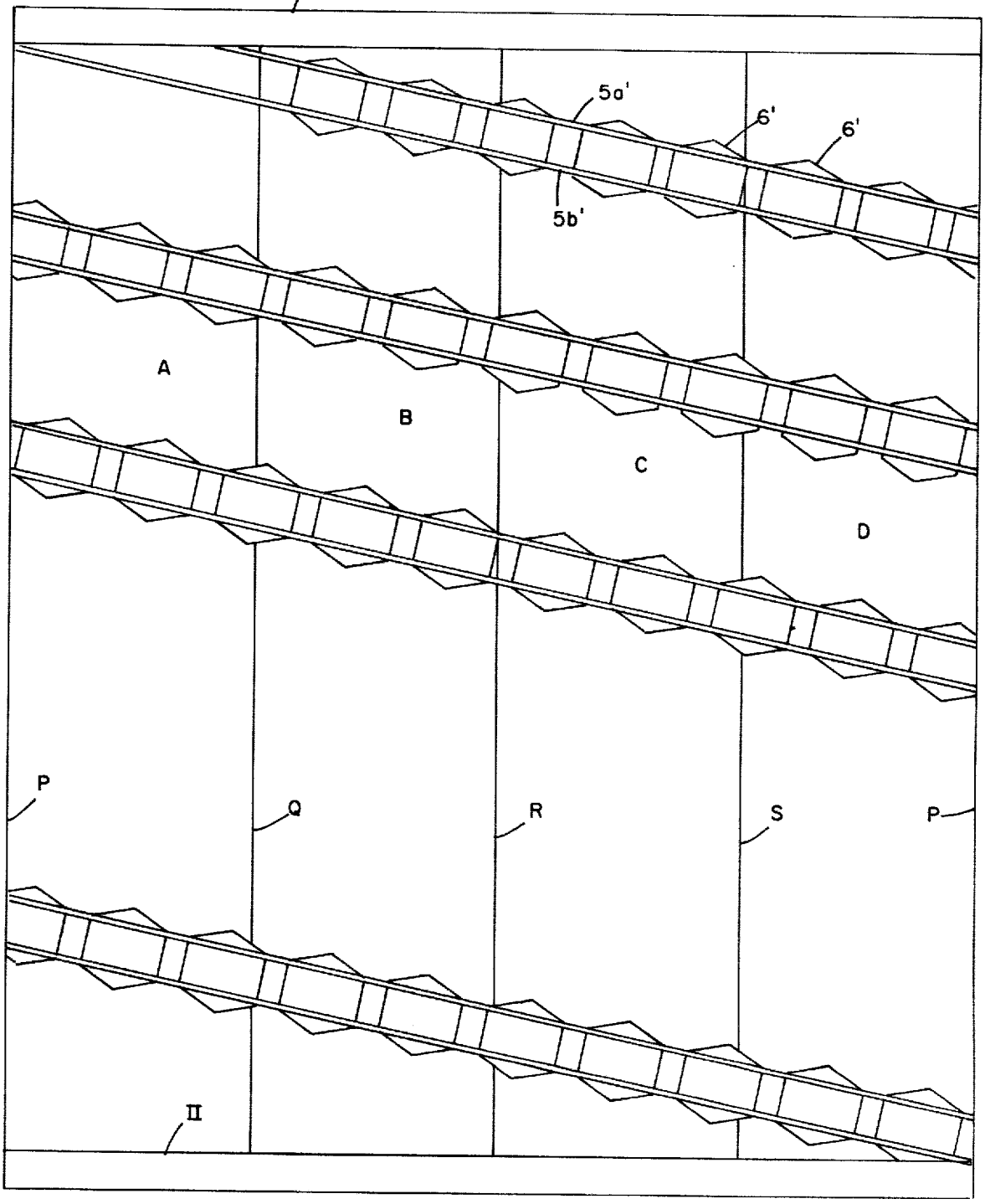

COMPOSITE FUSIBLE ELEMENT AND ELECTRIC FUSE COMPRISING THE ELEMENT

BACKGROUND OF THE INVENTION

This invention relates to composite fusible elements for electric fuses. In this context term "composite fusible element" refers to an element which is fabricated of several parts, preferably parts of silver and copper. The closest prior art known is listed below:

(1) U.S. Pat. No. 2,781,343; 02/12/57 to K. W. Swain for Current-Limiting Fuse Comprising Fuse Links of Silver and Copper.

(2) U.S. Pat. No. 2,809,257; 10/08/57 to K. W. Swain for Composite Fuse Links of Silver and Copper.

(3) U.S. Pat. No. 3,543,209; 11/24/70 to F. J. Kozacka for Composite Fuse Link and Fuse with Composite Fuse Link; and (4) U.S. Pat. No. 3,543,210; 11/24/70 to F. J. Kozacka for Current-Limiting Fuse Having Fuse Link with Longitudinal Groove.

The object of the above patents is to conserve silver, and to substitute copper for silver in portions of the fusible element where melting $i^2 \cdot t$ values and vaporization $i^2 \cdot t$ values are of relatively minor importance. This is also an object of the present invention but not its primary or sole object as will be apparent from what follows.

The manufacture of composite fusible elements involves punching, stamping or blanking operations. However, punching, stamping or blanking cannot normally be effected with a great amount of precision and small dimensional tolerances. As a rule of thumb, when using methods which are conventional in the art of manufacturing fuses, the width of the narrowest point of a fusible element may not exceed the thickness of the fusible element. There has been, and there is, a need to provide fusible elements with points of reduced cross-section that are smaller than the points of reduced cross-section that can readily be formed by a punching, stamping or blanking operation. Punching, stamping or blanking operations tend also to produce stresses in the particular fusible element which are most undesirable. The tendency to produce stresses is particularly large when the geometry of the fusible element is such that more or less sharp angles are formed in it. However, in many instances it is not possible to design fusible elements in such a way that sharp angles are avoided.

Ductile wires substantially circular in cross-section can be drawn so as to have smaller cross-sections than pieces of sheet metal can be reduced in cross-section by conventional punching, stamping or blanking operations. Thus the difficulties involved in the latter process, in particular the setting-up of stresses in a sheet of metal, can be overcome by the use of circular ductile wires.

It is, therefore, the prime object of this invention to provide fusible elements for electric fuses whose points of reduced cross-sectional area are formed by wires, and whose other current-carrying points of large cross-sectional area are formed by pieces of sheet metal.

Another object of this invention is to make the parts of the fusible element which should have small $i^2 \cdot t$ values of wires, and the other current-carrying parts of the fusible element where the $i^2 \cdot t$ values are less critical of a sheet metal having $i^2 \cdot t$ values which may be larger in comparison to those of the wires. Metals which comply with this condition are silver and copper, respectively.

In this context the term copper is intended to include alloys of copper which have substantially the same physical properties as electrolytic copper, and the term silver to include what is considered in the trade as pure silver, though it may have a certain amount of impurities.

SUMMARY OF THE INVENTION

A fusible element according to this invention comprises a pair of parallel straight drawn wires having a relatively small, substantially circular cross-section of a metal having a relatively small melting $i^2 \cdot t$, preferably silver. It further comprises a pair of plates of sheet metal arranged in the same plane, having a relatively large cross-section, lacking any point of reduced cross-section where arc initiation might occur under short-circuit conditions, and being of a metal having a relatively large melting $i^2 \cdot t$, preferably copper. An insulating gap separates said pair of plates. Said pair of wires extends across said gap and conductively interconnects said pair of plates.

In one embodiment of the invention an M-effect-causing metal is arranged on one of said pair of plates, in spaced relation from said gap and in spaced relation from the hottest points of said pair of wires when carrying current.

In another embodiment of the invention said gap is so narrow that the lengths of said pair of wires situated in said gap closely approximate point heat sources when carrying current.

In still another embodiment of the invention corrugations in said pair of plates extend in a direction longitudinally of said pair of wires and each of said pair of wires is inserted in one of said corrugations.

In still another embodiment of the invention intended for elevated circuit voltages the number of said pair of plates by far exceeds two, so that series multibreaks are formed substantially simultaneously upon fusion of said pair of wires under short-circuit-like conditions.

And in still another embodiment of the invention the number of serially arranged plates by far exceeds two, and the pair of wires extend along a substantially helical path in which the plates are arranged and bridges the insulating gaps formed between contiguous sheet metal plates.

BRIEF DESCRIPTION OF THE DRAWINGS

FIG. 6 shows another embodiment of the invention in top-plan view;

FIG. 7 shows the structure of FIG. 6 in side elevation; and

FIG. 8 shows diagrammatically a fusible element according to this invention arranged in a prismatic surface cut open along one of its edges and laid out in the plane of the paper in which FIG. 8 has been drawn.

DESCRIPTION OF PREFERRED EMBODIMENTS

Figure 1:
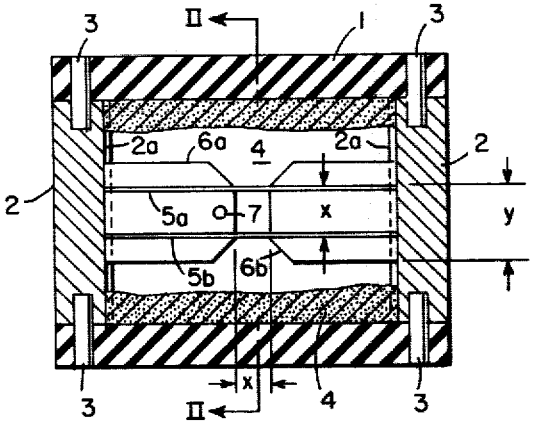
FIG. 1 is substantially a longitudinal section along a fuse having a fusible element embodying the present invention, the fusible element being shown in elevation rather than sectionalized.
Figure 2:
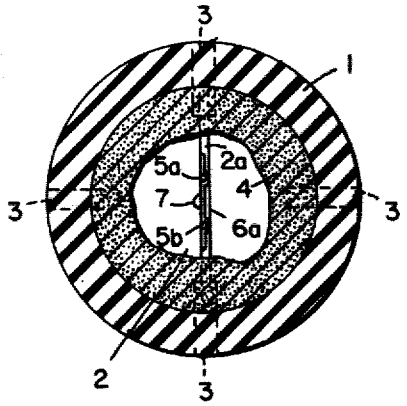
FIG. 2 is a section along II—II of FIG. 1.

Referring now to FIGS. 1 and 2 of the drawing, numeral 1 has been applied to designate a tubular casing of electric insulating material closed on the ends thereof by terminal elements 2 in the form of plugs. Pins 3 project through casing 1 into plugs 2, thus firmly uniting these two parts. The axially inner end surfaces of terminal plugs 2 are each provided with a radial groove 2*a* into which the axially outer ends of the fusible element generally designated by the numeral 4 are inserted. Fusible element 4 comprises a pair of wires 5*a*, 5*b* which are substantially circular in cross-section. Each fusible element 4 further comprises at least one pair of spaced plates 6*a*, 6*b* of sheet metal in contact with wires 5*a*, 5*b*. Electroconductive bonds not shown in FIGS. 1 and 2 conductively connect each of said pair of wires 5*a*, 5*b* and one of said pair of plates 6*a*, 6*b*. The axially outer ends of fusible element 4, or of plates 6*a*, 6*b*, respectively, are inserted into grooves 2*a* and conductively connected therein to plug terminals 2 as, for instance, by soft solder joints.

The welds conductively connecting wires 5*a*, 5*b* to plates 6*a*, 6*b* of sheet metal extend preferably along the entire length of plates 6*a*, 6*b*. Many methods may be applied to conductively join wires 5*a*, 5*b* to plates 6*a*, 6*b*, depending on the particular aims which govern the choice of a structure according to this invention. The various possibilities of joining wires 5*a*, 5*b* and plates 6*a*, 6*b* will be discussed below in more detail. At this point it may merely be stated that in any case the atoms of wires 5*a*, 5*b* must be brought sufficiently close to the nearest layer of the atoms of sheet metal plates 6*a*, 6*b* so that the forces of interatomic energy act, establishing a metallurgical bond between the two parts.

Fusible elements according to this invention have always two necks, or points of minimal cross-sectional area, in parallel, while a stamping may be provided with one single point of minimal cross-sectional area only which takes the places of the two necks in parallel. In order for the two designs under consideration to be electrically equivalent, the cross-sectional area of each of the wires 5*a*, 5*b* must be half the cross-sectional area of the point of minimal cross-sectional area of a stamped or blanked part. This can be achieved because wires of silver can, due to their ductility, be drawn to smaller diameters without the difficulties involved in making a stamping or blanking having a point of reduced cross-section of double the cross-section of the wires. The two wires of a fusible element as shown in FIGS. 1 and 2 have a relatively great resistance against torsional forces, while the neck, or point of minimal cross-sectional area, of a stamping has a far lesser resistance against torsional deformation. It can be shown that in case of torsional deformation of a single neck stamping, each planar transverse section through the neck is distorted into a non-planar, or curved, section which danger is not present in the fusible element of FIG. 1.

Particular advantages are obtained with wires 5*a*, 5*b* of silver if the spacing of said pair of plates 6*a*, 6*b* is close to zero, so that the sections of said pair of wires 5*a*, 5*b* situated between said pair of plates 6*a*, 6*b* approximate point heat sources when carrying current. Such fusible elements are particularly desirable for fuses that are used for the protection of solid state devices such as transistors, thyristors, etc. Fuses of this description have the advantage that the fusing and vaporization $i^2 \cdot t$ of their points of reduced cross-section is lower than that of copper, that silver wire, because of the ductility of silver, can readily be drawn to extremely small diameters without undue stresses occuring therein, and have a relatively great mechanical stability on account of the spacing y between their constituent wires 5*a*, 5*b*.

Figure 3:
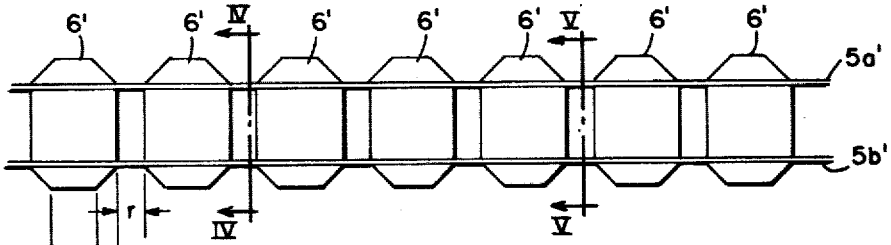
FIG. 3 is a front view of a fusible element for fuses intended for application in circuits having elevated voltages.

FIG. 3 shows a fusible element adapted to form series breaks upon fusion thereof. In FIG. 3 reference numerals 5*a*' and 5*b*' have been applied to indicate two spaced wires which consist of pure silver with the minimal impurites allowed therein. Reference character 6' has been applied to indicate spaced plates of copper bonded to wires 5*a*', 5*b*'. The interrupting process of a fusible element as shown in FIG. 3 involves three consecutive stages. First the wire sections r between contiguous sheet metal sections 6' melt and vaporize due to their minimal cross-section and their minimal fusing and vaporization $i^2 \cdot t$. Thereafter the sections s will melt and vaporize and finally sections t will melt and vaporize. Sections r of the fusible element form arcs in parallel which are unstable. Hence some of these arcs may extinguish temporarily, increasing the current and the back-burn velocity of arc gaps in parallel, and allowing the arc gap in which an arc is extinguished temporarily to cool down. This process is well known and used in many circuit interrupting devices, and it is an advantage of fusible elements according to the present invention that it is also applied in it.

Sometimes it is desirable to provide a fuse according to this invention with M-effect means, be it to limit the temperature to which the fusible element 5*a*, 5*b*, 6*a*, 6*b* may rise, or be it to be able to use the fuse for the protection against overload currents. In such instances an M-effect causing metal is placed on one of contiguous plates 6*a*, 6*b* away from the edges thereof. In FIG. 1 such an M-effect causing metal has been indicated by the reference numeral 7. The M-effect causing metal may be in the shape of an overlay. Because wires 5*a* and 5*b* have a much smaller heat-absorbing capacity and cross-section than plates 6*a* and 6*b*, the temperature of wires 5*a*, 5*b* in the interplate gap will be much higher than the temperature of the point at which M-effect means 7 are located. When part 7 fuses, the fused metal of which part 7 is made tends to flow to the adjacent part of the fusible element which is hottest and of silver. This will occur even if sheet metal parts 6*a*, 6*b* are heavily oxidized. Thus a precise interruption by M-effect is assured, because it takes place between the M-effect causing metal and silver rather than between the former and copper.

Figures 4, 4A, 4B, 5:
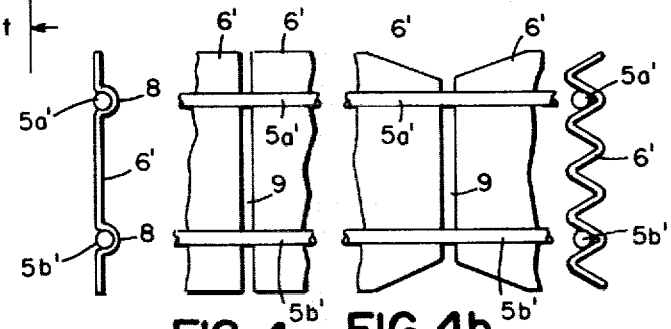
FIG. 4 is a section of a modification of the structure of FIG. 3 taken along IV—IV of FIG. 3.
FIG. 4*a* and FIG. 4*b* are a comparison between two plate geometries.
FIG. 5 is a section of a modification of the structure of FIG. 3 taken along V—V of FIG. 3.

Referring now to FIG. 4, this figure shows two spaced drawn fusible wires 5*a*' and 5*b*' of silver of which each is received in a groove 8 of a plate of copper 6'. Grooving of the plates 6' of copper facilitates the proper placing of wires 5*a*', 5*b*' on copper plates 6' for electrical connection of these two parts.

FIGS. 4*a* and 4*b* show details of two embodiments of the invention including silver wires 5*a*' and 5*b*' and copper plates 6' and 6' forming a gap 9 therebetween. In FIG. 4*a* the edges between plates 6',6' are parallel along their entire length, while in FIG. 4*b* the edges between plates 6' and 6' flare out near their ends. The lines of current flow are substantially the same in FIGS. 4*a* and 4*b*, but FIG. 4*b* shows an unexpected decrease of current-carrying capacity due to the reduction of its heat dissipating surface. One has, therefore, the choice between maximizing the current-carrying capacity at the cost of smaller control of the arc voltage, or achieving a higher current-carrying capacity at the cost of less control of the arc voltage.

According to FIG. 5 each of copper plates 6' has corrugations extending in a direction longitudinally of the pair of wires 5a', 5b'. *Wires 5a', 5b'* are inserted into one pair of said corrugations. The corrugations in plates 6' greatly increase the rate of heat exchange between these plates 6' and a pulverulent arc-quenching filler that normally surrounds the plates, as shown in FIGS. 1 and 2. The diameter of wires 5a', 5b' is less than the thickness of plates 6'. This relation of the dimensions of wires 5a', 5b' and the thickness of plates 6' has not been shown in FIGS. 4 and 5 because it is believed that FIGS. 4 and 5 are clearer when parts 5a', 5b' and 6' are shown therein as shown.

Wires 5a', 5b' are gradually reduced in diameter or cross-section by drawing them through diamond dies of progressively reduced cross-section. Since this is usually cold working, and the ductility of silver increases as its temperature is increased, annealing generally precedes any successive cold drawing step. Thus the amount of ductility required for silver wires of extremely small diameter may be readily achieved. Since the wires 5a', 5b' should preferably not be annealed after their diameter has been reduced to the smallest size required, because at this point of time there is no reason of increasing their ductility, the welding process for bonding wires 5a', 5b' to plates 6' should preferably be one not involving the heating of the wires. Hence, in critical instances, bonding processes relying on pressure between the parts to be joined rather than on heating of these parts are preferred.

Referring now to FIGS. 6 and 7, numerals 5a' and 5b' have been applied to indicate a pair of spaced wires which are welded to sheet metal elements 6a' and 6b'. Each of sheet metal elements 6a' and 6b' has an axially outer portion having a constant cross-sectional area and each of sheet metal elements includes two axially inner portions each of progressively reduced cross-sectional area. A pair of gaps is formed between the axially inner ends of the portions of sheet metal parts 6a ' and 6b' and these gaps are bridged by wires 5a' and 5b'. The triangular portions of parts 6a ' and 6b' result in a more gradual fusion of these parts.

FIG. 8 shows diagrammatically a fuse for elevated circuit voltages such as, e.g., 15 kv. Reference numerals I and II have been applied to indicate a pair of terminal plugs closing the ends of a tubular casing not shown in FIG. 8, corresponding to the casing 1 of FIGS. 1 and 2. The fusible element conductively interconnects terminal plugs I and II. It is arranged in a prismatic surface including four planar surfaces A,B,C and D. The prism A,B,C,D has four edges P,Q,R,S and has been cut open along edge P and stretched out to conform with the plane of the drawing paper. A helically shaped fusible element 5a', 5b' and 6' conductively interconnects terminal elements I and II. The plates of sheet metal 6' are bonded to wires 5a', 5b' and form a continuous ribbon-like structure. Breaks will form on the occurrence of short-circuit-like currents and each point of reduced cross-sectional area formed by wires 5a ' *and 5b'* forms one of a plurality of series breaks. This will provide sufficient arc voltage to inhibit further rise of the current under interruption. Thereafter the series arclets will burn back into the plates 6' which will generate a sufficiently high arc voltage to bring the current down to zero in less than a half cycle of the current wave.

The manufacture of composite fusible elements and of fuses according to this invention is more complex than the manufacture of conventional fusible elements and fuses. This is, in fact, no disadvantage because all the process steps required by this invention can readily be automated.

It will be apparent from the foregoing that the present invention relates to fusible elements or fuses, respectively, where circuit interruption is always initiated at the lengths of two parallel wires bridging an insulating gap, and never at a perforation, neck or point of reduced cross-section of the plates, such as plates 6a, 6b and 6'. This is true as far as major fault currents are concerned as well as far as overload currents are concerned.

Regarding the embodiment of the invention shown in FIG. 8, it will be apparent that when the fuse is assembled, plates 6' will be arranged along a substantially helical path and define a substantially helical surface. Wires 5a', 5b' extend along said path and around said surface, engage said plurality of plates 6' and bridge the insulating gaps formed between plates 6'.

I claim as my invention:

1. A composite fusible element for electric fuses comprising (a) a pair of parallel straight drawn wires having a relatively small substantially circular cross-section of a metal having a relatively small melting $i^2 \cdot t$;

(b) a pair of plates of sheet metal arranged in the same plane, having a relatively large cross-section, lacking any point of reduced cross-section where arc initiation might occur under short-circuit conditions, and being of a metal having a relatively large melting $i^2 \cdot t$; and (c) an insulating gap separating said pair of plates, said pair of wires extending across said insulating gap and conductively interconnecting said pair of plates.

2. A composite fusible element for electric fuses comprising (a) a pair of parallel straight drawn wires having a relatively small, substantially circular cross-section of a metal having a relatively small melting $i^2 \cdot t$;

(b) a pair of non-perforated plates of sheet metal arranged in the same plane, having a relatively large cross-section and being of a metal having a relatively large melting $i^2 \cdot t$;

(c) an insulating gap separating said pair of plates, said pair of wires extending across said insulating gap and conductively interconnecting said pair of plates; and (d) an M-effect causing metal arranged on one of said pair of plates, in spaced relation from said gap and in spaced relation from the hottest points of said pair of wires when carrying current.

3. A composite fusible element for electric fuses comprising (a) a pair of parallel straight drawn silver wires having a relatively small substantially circular cross-section;

(b) a pair of non-perforated plates of sheet copper arranged in a common plane, having a relatively large cross-section, lacking any point of reduced cross-section between the ends thereof where arc-initiation might occur under short-circuit conditions;

(c) an insulating gap separating said pair of copper plates, said pair of silver wires extending across said insulating gap and conductively interconnecting said pair of copper plate; and (d) said insulating gap being so narrow that the lengths of said pair of silver wires situated in said insulating gap closely approximate point heat sources when carrying current.

4. A composite fusible element for electric fuses comprising (a) a pair of parallel straight drawn silver wires having a relatively small substantially circular cross-section;

(b) a pair of non-perforated plates of sheet copper arranged in the same plane, having a relatively large cross-section and lacking any point of reduced cross-section between the ends thereof where arc-initiation might occur under short-circuit conditions;

(c) an insulating gap separating said pair of copper plates, said pair of silver wires extending across said insulating gap and conductively interconnecting said pair of copper plates; and (d) corrugations in said pair of copper plates extending in a direction longitudinally of said pair of silver wires, and each of said pair of silver wires being inserted into one of said corrugations.

5. A composite fusible element for electric fuses comprising (a) a pair of parallel straight drawn silver wires having a relatively small substantially circular cross-section;

(b) a pair of non-perforated plates of sheet copper arranged in a common plane, having a relatively large cross-section and lacking any point of reduced cross-section between the ends thereof;

(c) an insulating gap separating said pair of copper plates, said pair of silver wires extending across said insulating gap and conductively interconnecting said pair of copper plates; and (d) the number of said pair of copper plates by far exceeding two so that series multibreaks are formed upon fusion of said pair of silver wires under short-circuit-like conditions.

6. An electric fuse comprising a casing of electric insulating material, a pair of terminal elements closing the ends of said casing, a pulverulent arc-quenching filler inside said casing, and fusible element means embedded in said arc-quenching filler conductively interconnecting said pair of terminal elements, said fusible element means including (a) a pair of parallel straight drawn silver wires having a relatively small substantially circular cross-section;

(b) a pair of non-perforated plates of sheet copper arranged in the same plane, having a relatively large cross-section and lacking any point of reduced cross-section between the ends thereof where arc-initiation might occur under short-circuit conditions;

(c) an insulating gap separating said pair of copper plates, said pair of silver wires extending across said insulating gap and conductively interconnecting said pair of copper plates; and (d) said gap being so narrow that the lengths of said pair of silver wires situated in said gap approximate closely point heat sources when carrying current.

7. An electric fuse comprising a casing of electric insulating material, a pair of terminal elements closing the ends of said casing, a pulverulent arc-quenching filler inside said casing, and fusible element means embedded in said arc-quenching filler conductively interconnecting said pair of terminal elements, said fusible element means including (a) a pair of parallel straight drawn silver wires having a relatively small substantially circular cross-section;

(b) a pair of non-perforated plates of sheet copper arranged in a common plane, having a relatively large cross-section and lacking any point of reduced cross-section between the ends thereof where arc-initiation might occur under short-circuit conditions;

(c) an insulating gap separating said pair of copper plates, said pair of silver wires extending across said insulating gap and conductively interconnecting said pair of copper plates; and (d) corrugations in said pair of copper plates extending in a direction longitudinally of said pair of silver wires, and each of said pair of silver wires being inserted into one of said corrugations.

8. An electric fuse comprising a casing of electric insulating material, a pair of terminal elements closing the ends of said casing, a pulverulent arc-quenching filler inside said casing, and fusible element means embedded in said arc-quenching filler conductively interconnecting said pair of terminal elements, said fusible element means including (a) a pair of parallel straight drawn silver wires having a relatively small substantially circular cross-section;

(b) a pair of plates of sheet copper arranged in the same plane, having a relatively large cross-section and lacking any point of reduced cross-section between the ends thereof where arc-initiation might occur under short-circuit conditions;

(c) an insulating gap separating said pair of copper plates, said pair of silver wires extending across said insulating gap and conductively interconnecting said pair of copper plates; and (d) the number of said pair of copper plates by far exceeding two and said pair of copper plates being arranged in series so that multibreaks are formed upon fusion of said pair of silver wires under short-circuit-like conditions.

9. An electric fuse comprising a casing of electric insulating material, a pair of terminal elements closing the ends of said casing, a pulverulent arc-quenching filler inside said casing, and fusible element means embedded in said arc-quenching filler conductively interconnecting said pair of terminal elements, said fusible element means including (a) a pair of parallel drawn wires having a relatively small substantially circular cross-section of a metal having a relatively small melting $i^2 \cdot t$;

(b) a plurality of non-perforated serially arranged plates of sheet metal having a relatively large melting $i^2 \cdot t$, said plurality of plates being serially arranged, their number by far exceeding two;

(c) insulating gaps separating said plurality of plates from each other;

(d) said plurality of plates being arranged along a substantially helical path and defining a substantially helical surface; and (e) said pair of wires extending along said substantially helical path around said substantially helical surface, engaging said plurality of plates and bridging said insulating gaps.

10. An electric fuse as specified in claim 9 wherein said plurality of plates have their narrowest cross-section immediately adjacent said insulating gaps.

* * * * *